United States Patent [19]

Coyle, Sr. et al.

[11] Patent Number: 4,712,284

[45] Date of Patent: Dec. 15, 1987

[54] POWER TONGS WITH HYDRAULIC FRICTION GRIP FOR SPECIALITY TUBING

[75] Inventors: William E. Coyle, Sr., Houma; Dennis J. Penisson, Raceland, both of La.

[73] Assignee: Bilco Tools Inc., Houma, La.

[21] Appl. No.: 886,195

[22] Filed: Jul. 9, 1986

[51] Int. Cl.[4] ..... B25B 13/50

[52] U.S. Cl. ..... 29/240

[58] Field of Search ..... 269/268, 23, 25, 156, 269/287, 126; 81/57.2, 57.21, 98, 129, DIG. 9; 29/240

[56] References Cited

U.S. PATENT DOCUMENTS

| | | | |
|---|---|---|---|
| 1,837,645 | 12/1931 | Baash et al. | 81/98 |
| 1,837,689 | 12/1931 | Sunde | 269/25 |
| 2,765,136 | 10/1956 | Knapp | 269/286 |
| 2,800,867 | 7/1957 | Smith | 269/287 |
| 3,741,517 | 6/1973 | Pagonowski | 269/156 |
| 3,796,418 | 3/1974 | Carlberg . | |
| 3,921,473 | 11/1975 | Boyadjieff et al. . | |
| 4,057,887 | 11/1977 | Jones et al. . | |
| 4,092,881 | 6/1978 | Jurgens et al. | 29/240 |
| 4,402,239 | 9/1983 | Mooney . | |
| 4,523,743 | 6/1985 | Wang | 254/93 H |

FOREIGN PATENT DOCUMENTS

| | | | |
|---|---|---|---|
| 16972 | 12/1898 | Switzerland | 269/286 |

*Primary Examiner*—Robert C. Watson

*Attorney, Agent, or Firm*—Charles W. Fallow; Martin P. Hoffman

[57] ABSTRACT

A power tong is disclosed having a pipe gripping device including plural jaws activated by independent expansible chamber linear motors. An air-driven hydraulic pump, whose output pressure is limited by an adjustable relief valve, supplies fluid to the jaw motors. The jaw force can thus be closely controlled, independent of tongs torque.

9 Claims, 6 Drawing Figures

POWER TONGS WITH HYDRAULIC FRICTION GRIP FOR SPECIALITY TUBING

BACKGROUND OF THE INVENTION

In assembling a string of tubing for an oil well, a long series of pipe sections are screwed together, usually by means of a power tongs. Conventional power tongs have jaws with serrated faces that are designed to bite into the pipe surface. These jaws are usually cam operated, so that their closing force is roughly proportional to the tongs torque. Such an arrangement, however, is unsuitable for certain modern tube materials which are particularly soft. This is true for example, for some high chromium pipes designed for corrosion resistance rather than strength, and for fiber glass tubing now being developed. There are also pipes having protective coatings designed to protect the underlying material from corrosion by hydrogen sulfide and other subterranean chemicals. Some tubing costs on the order of one thousand dollars per foot, and a string is typically thousands of feet long. Plainly, it is critical not to damage tubing while making up a string, and to avoid any surface damage that could reduce service life.

Consequently, there is a need for power tongs whose jaws will not injure the surface of tubing and yet can deliver to the tubing adequate torque, which may be several thousands foot-pounds. The approach taken by this invention is to provide jaws actuated by hydraulic linear motors so that jaw pressure can be accurately controlled.

Hydraulically biased jaws on power tongs are known in the prior art; see, for example, U.S. Pat. Nos. 3,796,418, 3,921,473, 4,057,887 and No. 4,402,293. None of these however, provide means for independently controlling the jaw force.

It is therefore an object of this invention to construct a power tongs having jaws designed not to bite into the surface of pipe or tubing and yet able to transfer sufficient torque to the tubing.

Another object is to control jaw pressure independent of tongs torque. These and other objects will be apparent from the following description of a preferred embodiment of the invention.

The foregoing objects are met, according to this invention, by a power tongs having at least one hydraulically biased jaw, and means for controlling the hydraulic pressure delivered to the jaw. With this arrangement, smooth-faced jaws made of soft material can be used, and purely frictional engagement with the pipe surface suffices to make up the string.

DESCRIPTION OF THE PREFERRED EMBODIMENT

Figure 1:
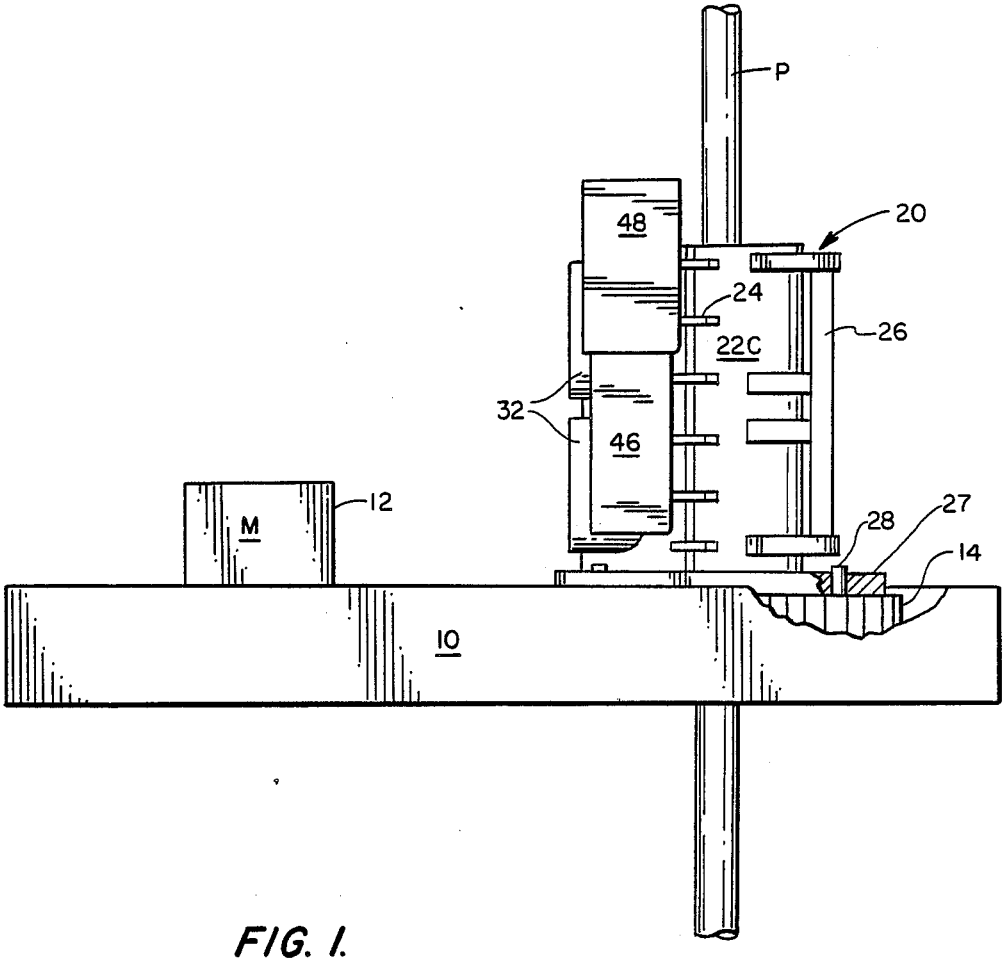
FIG. 1 is a side elevation of a power tongs embodying the invention.
Figure 2:
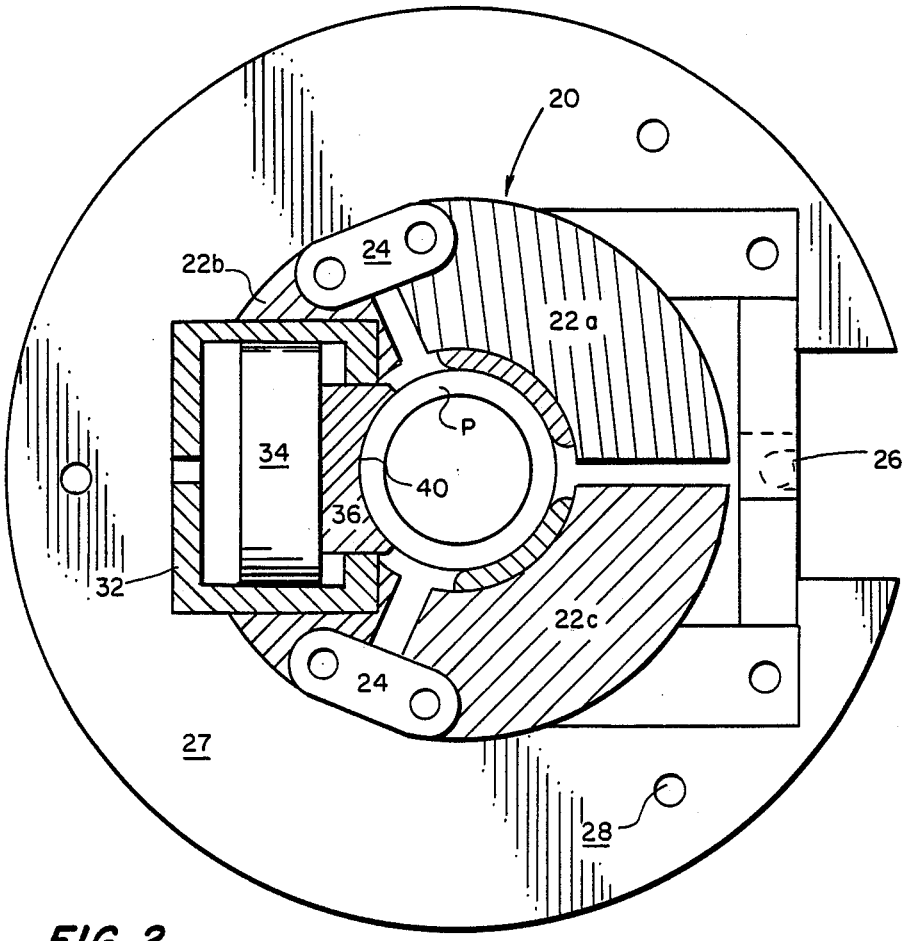
FIG. 2 is a top view thereof.

As shown in FIGS. 1 and 2, an apparatus embodying the invention comprises a power tongs 10 including a motor 12 driven by hydraulic fluid or other medium. Means (not shown) are provided for manually or automatically controlling the tongs motor. The tongs motor 12 is connected through gearing, not shown, to a rotary head 14, to which the pipe gripping assembly 20 of the invention is attached. The gripping assembly comprises plural (preferably three) segments *22a, 22b, 22c* equally spaced around a vertical axis corresponding to that of a pipe P that is to be torqued.

The segments 22 are interconnected by short links 24 that allow for variations in pipe diameter, and permit the segments to be opened, or closed around a pipe. The apparatus can be locked closed by means of a latch 26. One segment, *22b*, is attached to a base plate 27 that floats upon pins 28 extending vertically from the rotary head; the plate is normally centered on the pins by springs, not shown.

Referring to FIG. 2, at least one segment, *22b*, includes at least one (preferably two) short stroke hydraulic cylinders 32, each containing a piston 34 for driving a jaw 36 radially inward against the pipe P. The jaw 36, which is mounted in a slot 38 for free movement only in the radial direction, is preferably made of a soft material, such as aluminum, so that it will not scratch through pipe coatings, or damage pipes made of soft material. The hardness of the jaws thus may vary, according to the intended pipe material. For fiberglass pipe, the jaws may be harder than the pipe.

Figure 3:
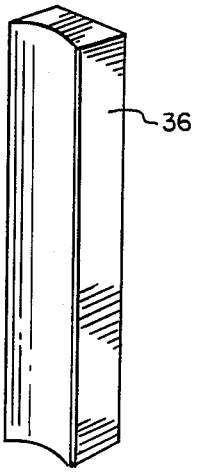
FIGS. 3 to 5 show three alternative jaw face contours.
Figure 4:
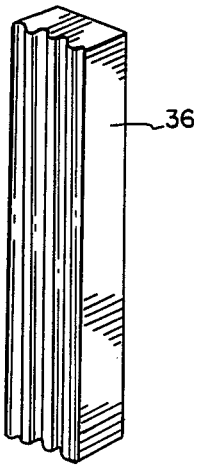
Figure 5:
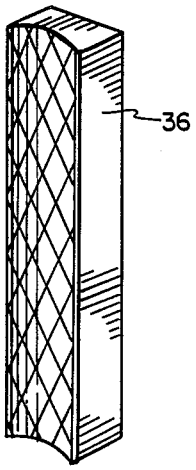

The gripping face 40 of each jaw is (FIG. 3) preferably smooth; that is, without teeth or other contours that might cut into and damage the pipe surface. This is particularly important for coated pipe, but as an alternative, the jaw surfaces may be "corrugated" as illustrated in FIG. 4. For fiberglass pipe, where surface damage can be tolerated, a serrated, knurled or toothed surface (FIG. 5) is preferred.

Figure 6:
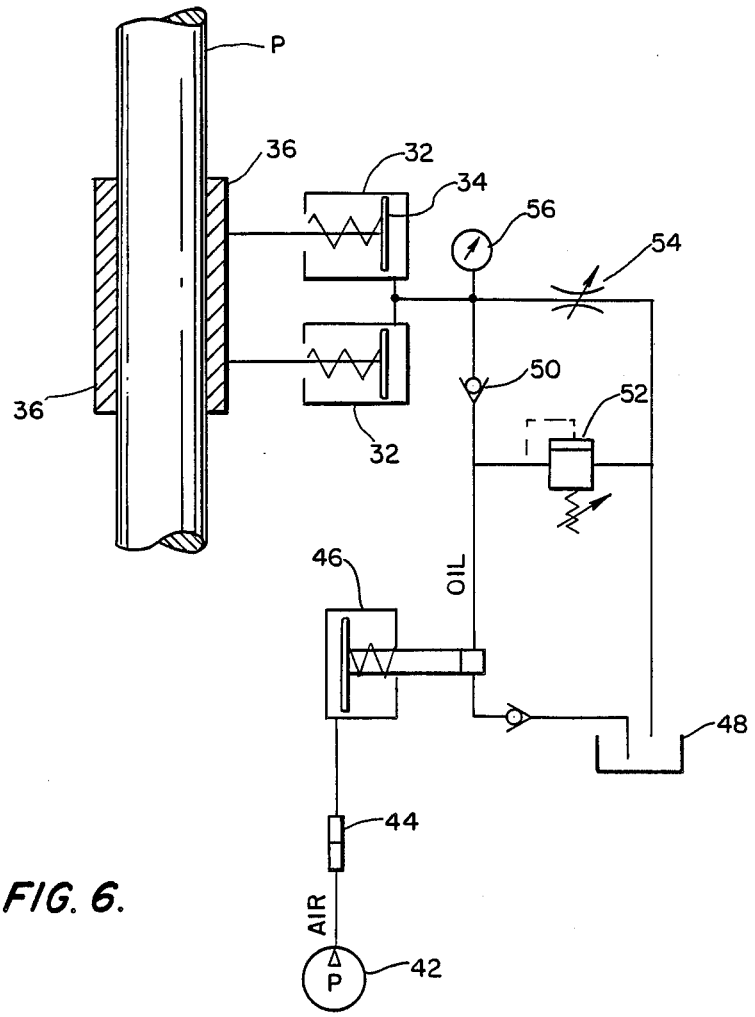
FIG. 6 is a schematic of the fluid circuitry of the invention.

FIG. 6 shows a schematic of the fluid circuit of this invention. An external compressed air source 42 is connectable, via a quick-connect fitting 44, to an air-driven hydraulic pump 46 mounted on the gripping device beneath an oil reservoir 48. The pump outlet communicates with the cylinders 32, in parallel, through a check valve 50 which prevents retrograde flow. A manually adjustable pressure relief valve 52 serves as means for controlling fluid pressure by bleeding excess pressure back to the reservoir. A manually operable, normally closed valve 54 can be opened to bleed all pressure from the cylinders 32 when it is desired to release the pipe. A gauge 56 indicates the actual cylinder pressure.

In operation, the tongs are brought, laterally, over a pipe joint P, FIG. 1, and the gripping assembly 20 is closed around the pipe by means of the latch 26. Air pressure from source 42 is then applied via fitting 44, whereupon the pump 46 generates hydraulic pressure within the cylinders 32, which pressure is limited by the setting of the pressure relief valve 52. The check valve 50 maintains the cylinder pressure after the air source is disconnected, whereafter there are no external hoses or other connections to the gripping device that would prevent it from rotating. The tongs are then activated, causing the gripping device and the pipe P to rotate with the rotary head until the desired torque is reached. Various torque limiters, such as those disclosed in U.S. Pat. Nos. 4,552,041 and 4,579,024, may be used to control the tongs, if desired.

To release the pipe P, the valve 54 is opened, allowing the pistons 34 to be retracted by their biasing springs as fluid escapes to the reservoir 48. The device may then be unlatched, and the tongs are then removed from the pipe.

The adjustability of the relief valve 52 enables one to control the actual clamping jaw force, independently of tongs torque. It is therefore possible, with this invention, to avoid excessive clamping pressures that could cause surface or structural damage to soft pipes. The service life of some of the most expensive tubing can thus be markedly prolonged. The pressure reaching cylinders 32 is limited by means of the adjustable pressure relief valve 52, which is set to a pressure that is a function of pipe material, size, makeup torque and possibly other factors. The upper pressure limit, for a given size jaw, is necessarily that pressure which would collapse or crush the pipe. However, the jaws may be made as long as desired; e.g., one foot long or more, so as to distribute jaw load over a greater surface area. As a result, by judicious design choice, any desired torque can be transferred to the pipe by the gripping assembly, without damaging the pipe surface.

With this invention, jaw forces are positively controlled and limitied, without regard to the tongs torque. This is in complete contrast to traditional cam-operated jaws, where jaw force is roughly proportional to tongs torque and is usually unknown in magnitude.

We have found that aluminum jaws with no teeth or surface irregularities whatsoever can be used with this invention. As long as the hydraulic cylinder pressure is properly set and controlled, such jaws are capable of developing very high torques through purely frictional engagement with the pipe surface. Since contact with the pipe is purely compressional, surface discontinuities are not created.

Another advantage of the invention is its simplicity, when compared to camming arrangements, resulting in lower production cost. A related advantage is that the invention can be easily modified to accept, for example, large diameter pipe casing, merely by adding more segments to the gripping device.

Various other modifications will occur to those of skill in the art, to create other uses for the invention. For example, the gripping device could be used in a (non-rotary) backup tongs. Also, high pressure water could be used in place of hydraulic fluid to drive the pistons 34, and such a modification would avoid the release of oil into the environment.

Inasmuch as the invention is subject to many variations and modifications, the foregoing description should be regarded as only illustrative of the invention, whose full scope should be measured by the following claims.

We claim:

1. In a power tongs for well pipe, having a rotary head with plural jaws mounted thereon for movement radially with respect to the pipe, the improvement comprising an air-driven pump for hydraulic fluid mounted on the rotary head, an expansible chamber motor mounted on the rotary head for driving at least one of the jaws radially inward against the pipe when hydraulic fluid under pressure from said pump is applied thereto, pressure controlling means operatively connected between said pump and said expansible chamber motor, whereby jaw force can be controlled independent of tongs torque, and a quick-connect fitting for temporarily connecting said air-driven pump to an external compressed air line in order to pressurize the expansible chamber motor and thus clamp the pipe between the jaws, and check valve means between said pump and said expansible motor permitting fluid to flow only in the direction of the latter, so that the line can thereafter be disengaged from the pump, thereby permitting unlimited rotation of the tongs head.

2. The invention of claim 1, wherein said pressure controlling means is a pressure relief valve situated between said pump and said expansible chamber means.

3. The invention of claim 2, wherein said expansible chamber means comprise plural hydraulic linear motors, at least one such motor being provided for each of said jaws.

4. The invention of claim 2, further comprising a normally closed valve parallel to said pressure relief valve, whereby the fluid within said expansible chamber means can be bled off to open said jaws.

5. The invention of claim 3, wherein said jaws are made of a material softer than said pipe.

6. The invention of claim 3, wherein said jaws are made of a material primarily comprising aluminum.

7. The invention of claim 3, wherein each of said jaws has a gripping surface defined by a cylinder of substantially the same radius as said pipe.

8. The invention of claim 3, wherein said gripping surface is smooth.

9. The invention of claim 3, wherein said gripping surface has corrugations running in the axial direction of said pipe.

* * * * *